US005569096A

United States Patent [19]

Lee

[11] Patent Number: 5,569,096

[45] Date of Patent: Oct. 29, 1996

[54] GOLF CLUB PUTTER HAVING ADJUSTABLE LIE ANGLE AND SHAFT LENGTH

[76] Inventor: Raymond H. Lee, 19035 Amber Valley Dr., Walnut, Calif. 91789

[21] Appl. No.: 454,516

[22] Filed: May 30, 1995

[51] Int. Cl.[6] ..... A63B 69/36; A63B 53/02

[52] U.S. Cl. ..... 473/248; 473/239

[58] Field of Search ..... 473/239, 245, 473/246, 247, 248, 316, 322, 323, 305, 306, 307, 308, 309, 310, 313; 138/118, 119, 121; 285/298, 302, 223

[56] References Cited

U.S. PATENT DOCUMENTS

| | | | |
|---|---|---|---|
| 1,982,087 | 11/1934 | Wantz | 473/239 |
| 3,102,726 | 9/1963 | Barrett | 473/239 |
| 3,191,936 | 6/1965 | Guier | 473/248 |
| 3,206,206 | 9/1965 | Santosuosso | 473/248 |
| 4,674,747 | 6/1987 | Mazzocco et al. . | |
| 5,244,205 | 9/1993 | Melanson et al. . | |
| 5,282,619 | 2/1994 | Napolitano et al. | 473/239 |
| 5,348,295 | 9/1994 | Phillips . | |

*Primary Examiner*—Steven B. Wong
*Attorney, Agent, or Firm*—Eugene Oak, Ph.D., J.D.

[57] ABSTRACT

A golf club putter having adjustable lie angle and shaft length comprises as major components a hollow handle, a shaft length adjusting mechanism, a shaft, a lie angle adjusting mechanism, and a putter. With the shaft inserted into the handle, threadably tightening a locking nut over a flexible ring and a external thread until the flexible ring is squeezed over the shaft prevents the shaft from slipping—thereby effectively locking the shaft in the desired length. When the locking nut is threadably loosened, the flexible ring is relaxed around the shaft and thereby the shaft is free to be lengthened or shortened. Applying an angular pressure to upper portion of the shaft bends bendable metal piece whereby a desired angle is achieved.

6 Claims, 4 Drawing Sheets

GOLF CLUB PUTTER HAVING ADJUSTABLE LIE ANGLE AND SHAFT LENGTH

BACKGROUND OF THE INVENTION

1. Field of the Invention

This invention relates generally to an improvement in the art of golf club putter and particularly to a golf club putter having adjustable lie angle and shaft length.

2. Description of the Prior Art

The sport of golfing has become very popular in the U.S. as well as internationally. Enthusiasts of all ages enjoy the sport and have developed a special technique and/or style in how they use the golf clubs.

Golf putters are made with various types of heads and lie angles. Depending on its size, length, weight, and lie angle, a user selects the putter that feels most comfortable. Furthermore, golfers have many styles of putting which determines which putter is selected.

The prior art discloses a variety of golf clubs that were developed to enhance and accommodate the putting skills of different users.

U.S. Pat. No. 5,348,295 issued to Phillips discloses a golf putter with an adjustable shaft attached to a removable sphere with set screws which permits movement of the shaft. This device is relatively complex and has many drawbacks.

The patent to Melanson et al., U.S. Pat. No. 5,244,205 relates to an adjustable lie angle golf club putter having an elongated slot in the putter head with aligned boreholes in the walls of the slot. The shaft is secured to a hosel member which terminates in a tang having parallel flat sides which mate with the slot. This golf putter, too, has inherent disadvantages and complex interlocking mechanism.

Mazzocco et al. in U.S. Pat. No. 4,674,747 discloses a golf club having adjustable length shaft retractable between fully extended and collapsed positions. The golf club has plural concentric telescopic interlocking tubular sections which produce a friction lock between the tubular sections in a fully extended position.

Although these prior arts disclose various improvement in the art, a number of these prior devices have complex interlocking mechanism and inherent drawbacks. These prior arts do not contain a particular structure and novelty as disclosed and claimed hereinafter.

Accordingly, the principal object of the present invention is to provide a simple adjustable golf club putter with an adjustable shaft length.

It is another object of the present invention to provide an improved golf club putter with an adjustable lie angle.

It is yet another object of the present invention to provide an improved golf putter that enhances the user's putting skills.

SUMMARY OF THE INVENTION

The present invention is an improved golf club putter having an adjustable lie angle and shaft length. At the tip portion of the shaft, a bendable metal piece with riffle edges on one adjacent side is inserted into the shaft and the stem to allow angular movement between the head and shaft. A rubber cover surrounds the bendable metal piece for appearance purposes. A tripod style screw in the upper portion of the shaft allows it to be retractable between fully extended and collapsed positions. A grip surface surrounds the shaft to eliminate any slippery conditions.

These together with other objects of the invention are pointed out clearly in the claims annexed to and forming a part of this disclosure. For a better understanding of the invention, its operating advantages and the specific objects attained by its use, reference should be made to the accompanying drawings and descriptive matter in which there are illustrated preferred embodiments of the invention.

BRIEF DESCRIPTION OF THE DRAWINGS

For a better understanding of the principle and nature of the present invention, references should be made to the following detailed description taken in connection with the accompanying drawings in which.

DETAILED DESCRIPTION OF THE PREFERRED EMBODIMENT

Figure 1:
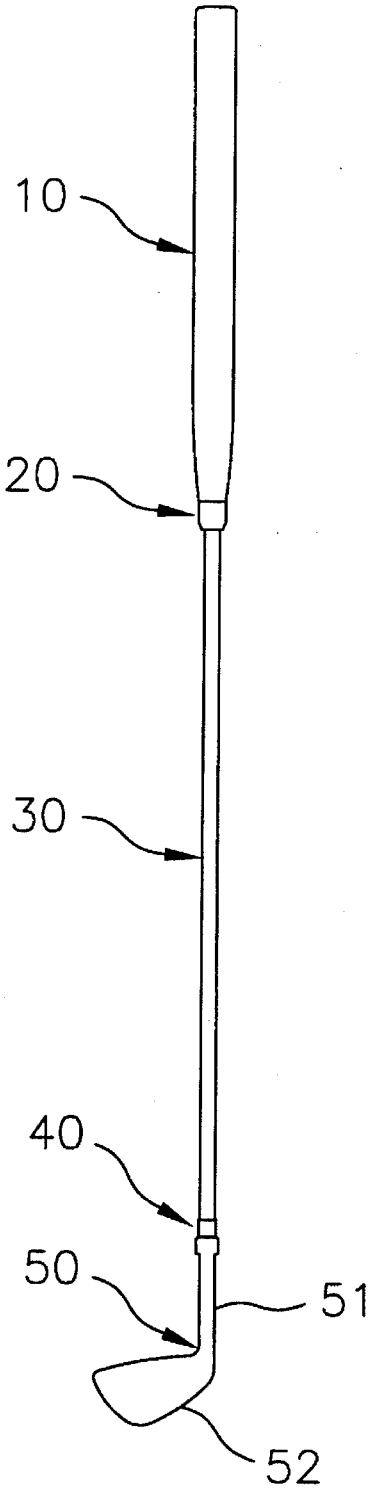
FIG. 1 is an over all of the present invention.
Figure 2:
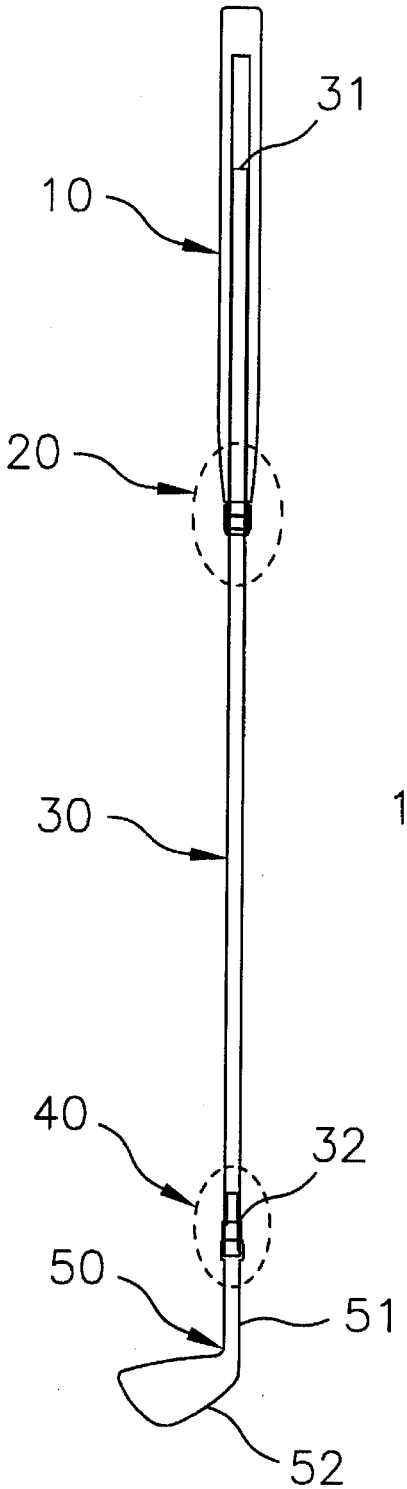
FIG. 2 is a sectional view of the present invention.

Referring now to FIGS. 1 and 2, the golf club putter having adjustable lie angle and shaft length comprises as major components a hollow handle 10, a shaft length adjusting mechanism 20, a shaft 30 having a first end 31 and a second end 32, a lie angle adjusting mechanism 40 and a putter 50 having a putter head 51 and a stem 52.

Figure 3:
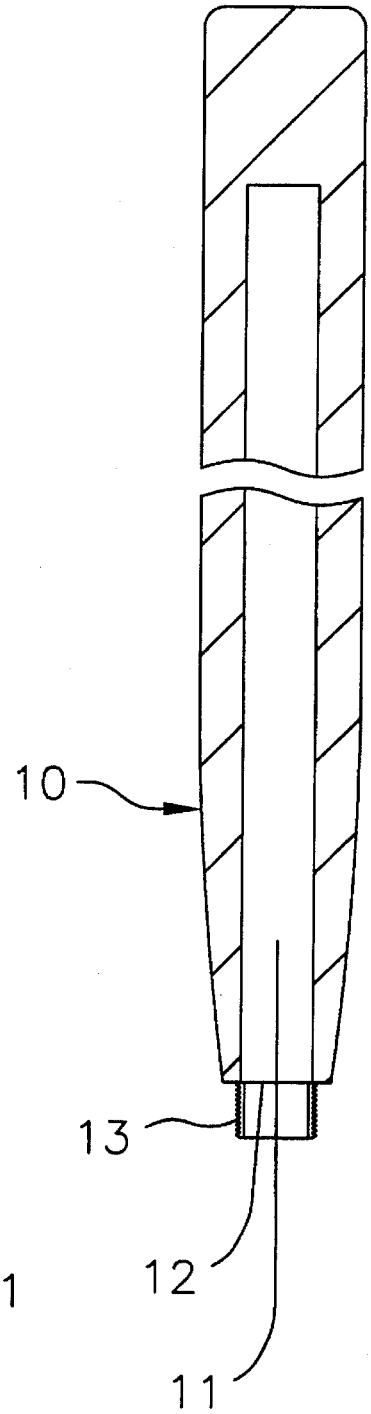
FIG. 3 is a sectional view of the handle.

As shown in FIG. 3, the hollow handle 10 comprises a shaft chamber 11 annularly formed at its longitudinal center, an opened end 12, and an externally threaded ring 13 attached to the opened end 12.

Figure 4:
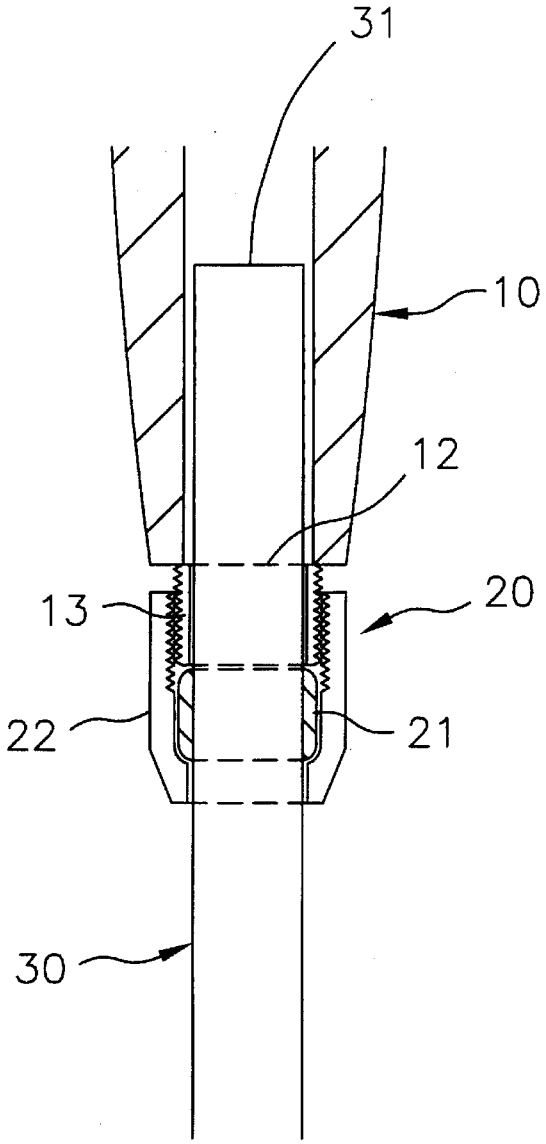
FIG. 4 is a sectional view of the shaft length adjusting mechanism in its unlocked position.
Figure 5:
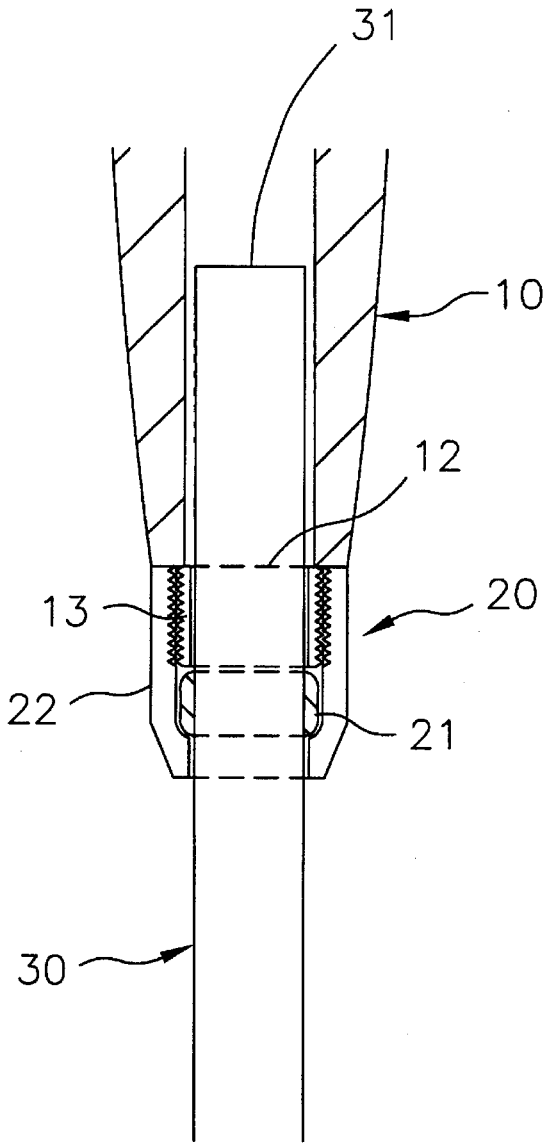
FIG. 5 is a sectional view of the shaft length adjusting mechanism in its locked position.

As detailed in FIGS. 4 and 5, the shaft length adjusting mechanism 20 threadably located at the opened end 12 of the handle 10 is shown in its locked and unlocked positions, respectively. The shaft length adjusting mechanism 20 comprises the externally threaded ring 13 attached to the opened end 12 of the handle 10, a flexible ring 21 disposed therebelow, and an internally threaded locking nut 22 first covering the flexible ring 21 and then threadably mated to the external thread 13.

The first end 31 of the shaft 30 is initially inserted through the shaft length adjusting mechanism 20 and subsequently into the shaft chamber 11 until desired length is obtained. The locking nut 22 is then threadably tightened over the flexible ring 21 and the external thread 13 until the flexible ring 21 is squeezed over the shaft 30 and prevents the shaft 30 from slipping—thereby effectively locking the shaft in the desired length. In addition to gripping the shaft 30 in place, the flexible ring 21, due to its soft non-metallic material, also prevents the surface of the shaft from getting nicked. When the locking nut 22 is threadably loosened, the flexible ring 21 is relaxed around the shaft 30 and thereby the shaft is free to be lengthened or shortened.

Figure 6:
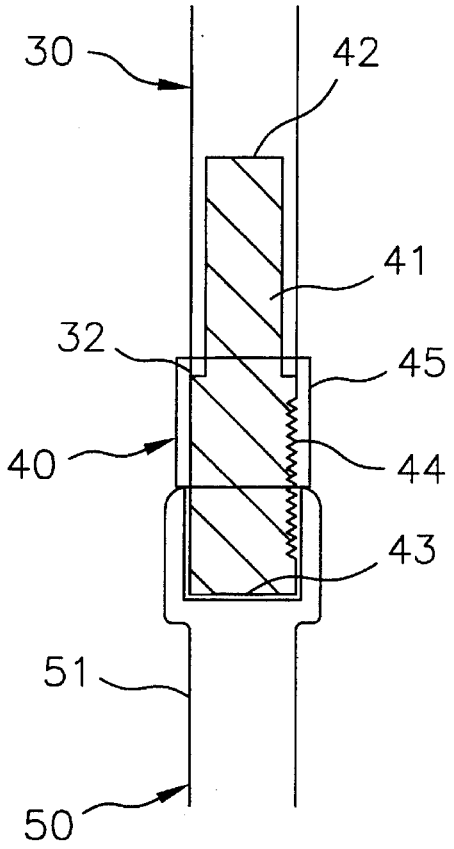
FIG. 6 is a close-up view of the lie angle adjusting mechanism illustrating an erect position.
Figure 7:
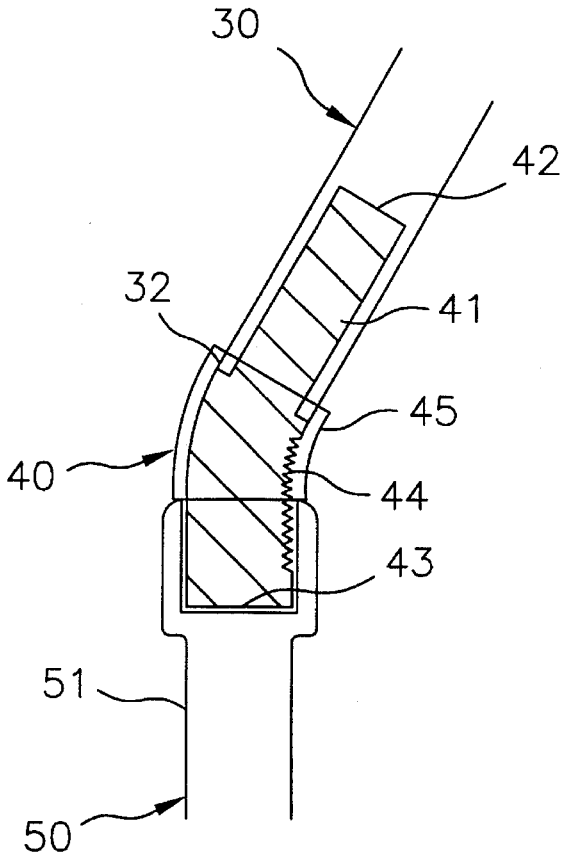
FIG. 7 is a close-up view of the lie angle adjusting mechanism illustrating a bent position.
Figure 8:
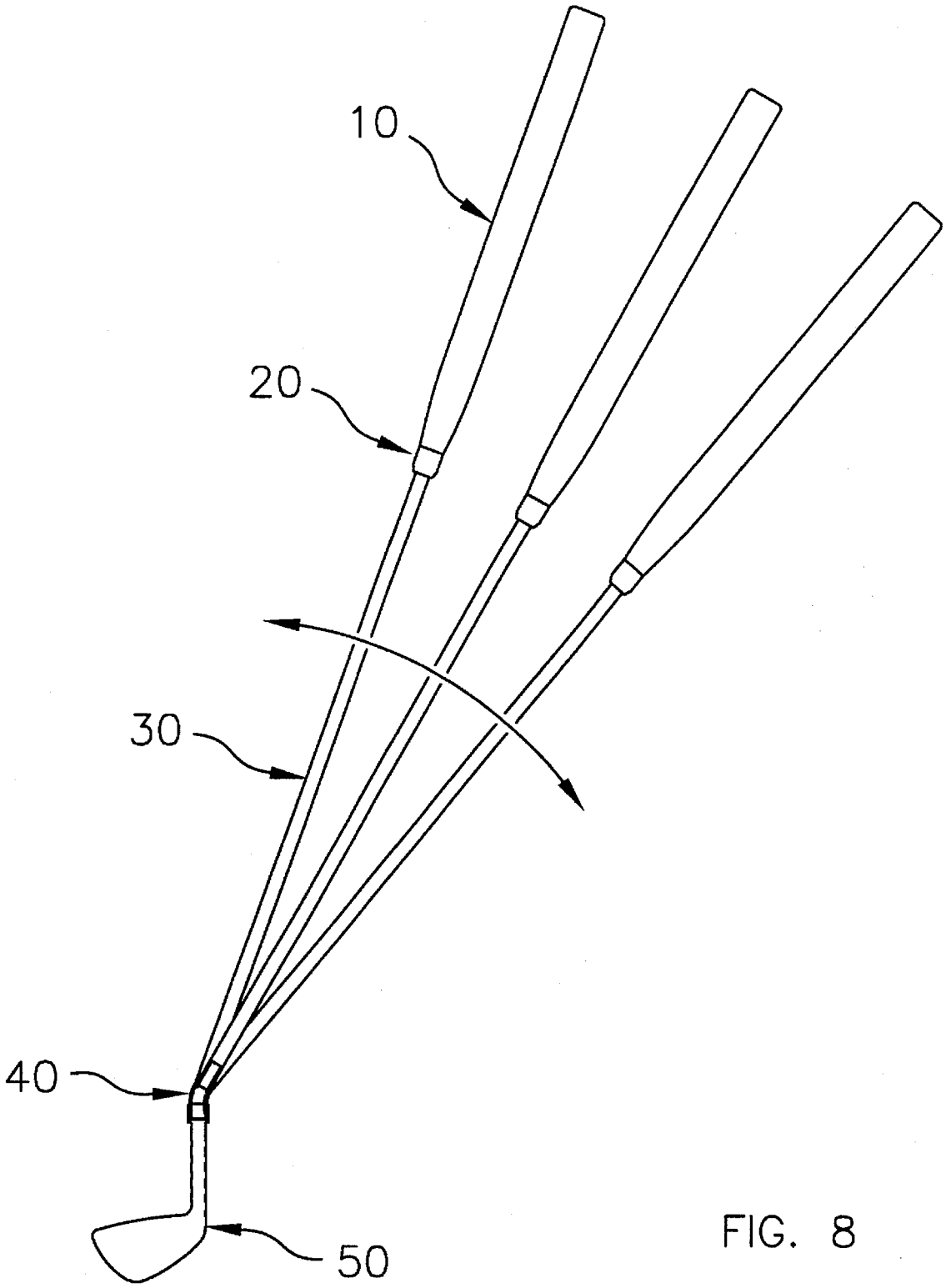
FIG. 8 is a side view of the present invention illustrating the adjustability of the lie angle.

Referring now to FIGS. 6 and 7, a close-up view of the lie angle adjusting mechanism 40 located at the second end 32 of the shaft 30 is shown in its erect and bent positions, respectively. The lie angle adjusting mechanism 40 comprises a bendable metal piece 41 having a first end 42, a second end 43, and a riffle edge 44 formed on one longitudinal side only. The first end 42 of the bendable metal piece 41 is inserted into the second end 32 of the shaft 30 and the second end 43 of the bendable metal piece 41 is inserted into the stem 51 of the putter 50. The rubber cover 45 covers the second end 32 of the shaft 30, the bendable metal piece 41, and the stem 51 to prevent debris from entering the lie angle adjusting mechanism 40 and to enhance the cosmetic appearance of the golf club putter. As an angular pressure is given to the upper portion of the shaft 30, the riffle edge 44 of the bendable metal piece 41 allows for easier bending to achieve a desired angle. FIG. 8 illustrates the angular adjustability of the present invention.

While the present invention has been disclosed with reference to a particular example of preferred embodiment, it is the applicant's intention to cover all modifications and equivalents within the scope of the following appended claims. It is therefore requested that the following claims be given a liberal interpretation which is within the spirit and scope of the applicant's contribution to this art.

What is claimed as being new and therefore desired to be protected by Letter patent of the U.S. is as follows:

1. A length adjustable golf club putter comprising:

a. a hollow handle having a shaft chamber annularly formed at its longitudinal center, an opened end, and an externally threaded ring attached to said opened end;

b. a shaft having a first end and a second end, wherein said first end is inserted into said shaft chamber of said handle;

c. a locking mechanism located at said opened end of said handle and comprising;

(1) said externally threaded ring;

(2) a flexible ring made of soft non-metallic material disposed therebelow; and (3) an internally threaded locking nut first covering said flexible ring and then threadably mated to said external thread;

d. a stem and a putter head; and e. an adjustable lie angle mechanism located at said second end of said shaft and comprising:

(1) a bendable metal piece having a first end, a second end, and a riffle edge located between said first end and said end second and formed on one longitudinal side only;

(2) wherein said first end of said bendable metal piece is insertably attached to said second end of said shaft;

(3) wherein said second end of said bendable metal piece is insertably attached to said stem of said putter; and (4) a rubber cover covering said end of said shaft, said bendable metal piece, and said stem.

2. The length adjustable golf club putter as set forth in claim 1, wherein threadably tightening, said locking nut over said flexible ring with said first end of said shaft inserted into said shaft chamber of said handle locks said shaft in place and thereby prevents shaft length adjustability.

3. The length adjustable golf club putter as set forth in claim 2, wherein said flexible ring due to its soft non-metallic material prevents surface of said shaft from getting nicked.

4. The length adjustable golf club putter as set forth in claim 2, wherein threadably loosening said locking nut relaxes said flexible ring around said shaft and thereby freeing said shaft for shaft length adjustability.

5. The length adjustable golf club putter as set forth in claim 1, wherein said rubber cover prevents debris from entering said lie angle adjusting mechanism.

6. The length adjustable golf club putter as set forth in claim wherein applying angular pressure to upper portion of said shaft provides lie angle adjustment.

* * * * *